US010337240B2

(12) United States Patent
Hall et al.

(10) Patent No.: US 10,337,240 B2
(45) Date of Patent: Jul. 2, 2019

(54) WINDOW BLINDS WITH CAPACITOR IN SLATS TO CHARGE SLATS AND CLEAN THE AIR

(71) Applicants: David R. Hall, Provo, UT (US); Emily Brimhall, Alpine, UT (US); Austin Carlson, Provo, UT (US); Terrece Pearman, Draper, UT (US)

(72) Inventors: David R. Hall, Provo, UT (US); Emily Brimhall, Alpine, UT (US); Austin Carlson, Provo, UT (US); Terrece Pearman, Draper, UT (US)

(73) Assignee: Hall Labs LLC, Provo, UT (US)

( * ) Notice: Subject to any disclaimer, the term of this patent is extended or adjusted under 35 U.S.C. 154(b) by 235 days.

(21) Appl. No.: 15/457,458

(22) Filed: Mar. 13, 2017

(65) Prior Publication Data

US 2018/0258690 A1 Sep. 13, 2018

(51) Int. Cl.
*E06B 9/28* (2006.01)
*E06B 9/386* (2006.01)
(Continued)

(52) U.S. Cl.
CPC ..... *E06B 9/28* (2013.01); *B03C 3/47* (2013.01); *B03C 3/60* (2013.01); *B03C 3/66* (2013.01);
(Continued)

(58) Field of Classification Search
CPC . E06B 9/28; E06B 9/323; E06B 9/386; B03C 3/60; B03C 3/66; B03C 3/47; B03C 3/746; B03C 3/08
See application file for complete search history.

(56) References Cited

U.S. PATENT DOCUMENTS 4,264,343 A * 4/1981 Natarajan ..... B03C 3/38 361/230
7,465,338 B2 * 12/2008 Kurasek ..... B03C 3/09 95/75
(Continued)

FOREIGN PATENT DOCUMENTS

CN 105840082 A * 8/2016
GB 1483599 A * 8/1977 ..... B03C 3/47
KR 20180101844 A * 9/2018 ..... B03C 3/08

OTHER PUBLICATIONS

Machine translation: CN 105840082, retrieved from https://worldwide.espacenet.com/publicationDetails/biblio?CC=CN&NR=105840082A&KC=A&FT=D&ND=3&date=20160810&DB=&locale= (Year: 2016).*

*Primary Examiner* — Katherine W Mitchell
*Assistant Examiner* — Abe Massad

(57) ABSTRACT

We disclose a window blind that includes a capacitor within each slat. Each plate of the capacitor may be connected to one of two batteries. At least one switch may be placed between each capacitor plate and its adjoining battery. When one switch is open, another switch may be closed thereby sending current to only one plate at a time. The plate that receives the current is negatively charged and the remaining plate is positively charged. The switch that is open may be changed to reverse the charges of the plates. This charge reversal may be actuated through a series of pull cord gestures from a user. By creating an electrical charge on the plates, dust is pulled from the air according to the net charge of the dust particles. The window blind therefore functions as an air purifier as well as a traditional window blind.

17 Claims, 8 Drawing Sheets

(51) Int. Cl.

| | |
|---|---|
| ***B03C 3/47*** | (2006.01) |
| ***B03C 3/66*** | (2006.01) |
| ***B03C 3/60*** | (2006.01) |
| ***E06B 9/323*** | (2006.01) |
| ***F24F 13/00*** | (2006.01) |

(52) U.S. Cl.
CPC ..... *E06B 9/323* (2013.01); *E06B 9/386* (2013.01); *F24F 13/00* (2013.01)

(56) References Cited

U.S. PATENT DOCUMENTS

| | | | | |
|---|---|---|---|---|
| 8,950,461 | B2 * | 2/2015 | Adams | E06B 9/32 160/84.02 |
| 9,489,834 | B2 * | 11/2016 | Hall | G01R 19/0092 |
| 9,646,806 | B2 * | 5/2017 | Jang | A61L 2/088 |
| 2004/0145853 | A1 * | 7/2004 | Sekoguchi | A61L 9/22 361/225 |
| 2016/0243559 | A1 * | 8/2016 | Kim | B03C 3/47 |
| 2017/0120256 | A1 * | 5/2017 | Jeon | B03C 3/47 |
| 2017/0241656 | A1 * | 8/2017 | Fox | B01D 46/10 |
| 2018/0250685 | A1 * | 9/2018 | Noh | B03C 3/08 |

* cited by examiner

WINDOW BLINDS WITH CAPACITOR IN SLATS TO CHARGE SLATS AND CLEAN THE AIR

BACKGROUND

Field of the Invention

This disclosure relates to window blinds and air purifiers.

Background of the Invention

Standard window blinds regularly get dirty and need to be cleaned. This process can be tedious and time consuming. Dust particles in a room can pose health challenges for individuals with respiratory problems, such as asthma. Dust particles in a house can be either positively or negatively charged. These particles can be attracted to materials with an opposite charge. A capacitor connected to a battery may allow charge to build up such that each side may attract dust particles of an opposite charge.

It is desirable to have devices in a room which may filter dust particles from the room for the health and comfort of the inhabitants of the room. A window blind is needed which attracts dust particles using electrostatic forces toward plates attached directly to the window blind slats, which can then be easily wiped off periodically.

BRIEF SUMMARY OF THE INVENTION

We disclose a window blind that incorporates capacitors into each of the slats such that the charge on each slat may filter dust particles from the air. The capacitors may each include two plates separated by a dielectric medium. Each of the two plates within each slat may be connected to one of two batteries. Switches along the electrical connections between the batteries and their respective capacitor plates may interrupt or complete the connection between each battery and plate.

In addition, the switches may be modulated to allow current to flow from the anode of one battery to its connected plate but not from the other battery to its connected plate and then reversed. Consequently, the polarity of the capacitors may be reversed. Thus, the positively charged dust particles may adhere to a plate that is negatively charged. Then the polarity of the capacitor may be reversed by modulating the switches causing the same plate to be positively charged and attract negatively charged dust particles.

The switches may be modulated by interpreting user's gestures on a pull cord. The different gestures may be translated to electrical signals which modulate different switches to reverse the polarity of the capacitors. The gestures may also modulate switches that complete the circuit between the capacitor and at least one of the batteries so that charge does not build up on the capacitor plates and the slats may be wiped down to remove dust particles that have adhered thereto.

DETAILED DESCRIPTION OF THE INVENTION

Definitions

Figure 1A:
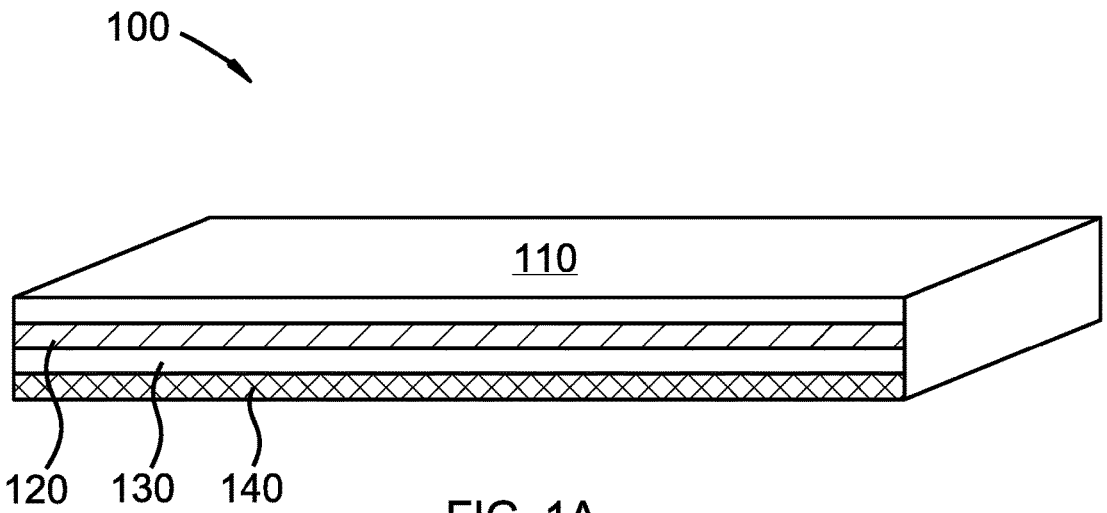
FIG. 1A illustrates a longitudinal cross-sectional view an embodiment of a slat of the disclosed window blind.

Window blind, as used herein, means a blind that covers an opening in a building, including a window or door.

While this invention is susceptible of embodiment in many different forms, there are shown in the drawings, which will herein be described in detail, several specific embodiments with the understanding that the present disclosure is to be considered as an exemplification of the principals of the invention and is not intended to limit the invention to the illustrated embodiments.

We disclose a window blind that may clean dust from the air by electrically attracting dust particles to the slats of the blind. The window blind may have a plurality of slats, each of which may include a capacitor. In some embodiments, each slat may comprise two plates and a dielectric medium between the two plates. The two plates may be made of one or more of the following materials: aluminum, tantalum, silver, and brass. The dielectric medium may be made of one or more of the following materials: glass, ceramic, paper, mica, porcelain, polyethylene, polyimide, polypropylene, polystyrene, titanium dioxide, strontium titanate, barium strontium titanate, barium titanate, calcium copper titanate, biaxially-oriented polyethylene terephthalate, and polytetrafluoroethylene. The top plate of the slat may be electrically connected to the anode of a first battery. Alternatively, the bottom plate of the slat may be electrically connected to the anode of a second battery. However, both plates are not electrically connected to their respective batteries at the same time. In some embodiments, both batteries are contained in a headrail. In some embodiments, both plates are exposed to the air, one on the top of each slat and one on the bottom of each slat. In other embodiments, only one plate is exposed to the air and the other plate is within the slat. In some embodiments, the plates are set within a frame which may be constructed from nonconductive material. The nonconductive material may be of a decorative nature.

Each electrical connection may be completed by a switch. The first switch may be placed along an electrical connection between the anode of the first battery and the first plate and the second switch may be placed along an electrical connection between the anode of the second battery to the second plate. When the first switch is in a first position, it may electrically connect the first plate to the anode of the first battery. This electrical connection may thus allow current to flow from the first battery to the first plate. The dielectric medium prevents the current from flowing to the second plate. Consequently, the first plate acquires a negative charge. The negative charge on the first plate repels electrons on the second plate causing the second plate to acquire a positive charge. In this situation, positively charged dust particles adhere to the negatively charged first plate and negatively charged dust particles adhere to the second plate. Also, the switches that connect the second battery to the capacitor plates may be in an open position so that the second battery is not in electrical connection with the capacitor.

The polarity of the capacitor plates may be reversed by modulating the switches in the electrical pathways. By opening at least the first switch, the electrical pathway from the anode of the first battery to the first plate is broken. By also closing at least a second switch an electrical connection from the anode of the second battery to the second plate is created allowing current to flow from the second battery to the second plate. The second plate now has the negative charge and the first plate has the positive charge.

For safety purposes and for cleaning the slats, the electrical connections between the capacitor plates and the batteries may include a third switch. When closed, the third switch may complete a circuit between the first plate and the first battery or between the second switch and the second battery. Thus, the electrical energy stored in the capacitor within each of the slats may be released and neither plate will hold a charge. The user may then wipe down the slats to remove the dust that has adhered to the capacitor plates.

The window blind may also include a pull cord. It may be desirable to operate the switches simply by interpreting user's gestures on the pull cord. The pull cord may convert gestures from a user to control the electrical connections using mechanisms first disclosed in U.S. Pat. No. 9,489,834 filed on Apr. 9, 2015 which is hereby incorporated by reference in its entirety.

In some embodiments, a switching mechanism may convert a pull gesture into an electrical signal. A controller may receive the electrical signal from the cord gestures and translate the signal into operational commands to control the first or second switches. These pull gestures may include, but are not limited to, number of pulls, strength of pulls, or a combination of number and strength of pulls. The switching mechanism may understand cord gestures in a single direction or in multiple directions.

In one embodiment of the invention, the pull cord may move in a lateral motion such that the pull cord may slidably move a sliding connector to a first or a second position. In this embodiment, the sliding connector may only electrically connect with first contact when the connector is in the first position and only electrically connect with second contact when the connector is in the connect position. In another embodiment, the pull cord may move in a vertical motion such that the pull cord applies force to a deflectable arm. When the pull cord is in a first position, the deflectable arm may be moved from a first position to a second position. When the pull cord has been pulled into a second position, the deflectable arm may be moved from a second position to a first position.

In some embodiments, it may be desirable to have an air-moving device that may direct the flow of air towards the slats, and thus direct the dust particles near the charged window slats. In some embodiments, the air-moving device may be contained in the headrail. In this embodiment, the air moving device may direct air towards the top of each of the slats. In other embodiments, the air-moving device may be contained in a bottom rail and direct air towards the bottom of each of the slats.

Referring now to the drawings, FIG. 1A illustrates a longitudinal cross-sectional view of slat 100 which may be included in an embodiment of the disclosed window blind. Slat 100 includes first plate 110 and second plate 130 which are separated by dielectric medium 120 (shown cross-hatched). In the embodiment of FIG. 1A, plate 130 is located inside of slat 100. Bottom layer 140 of slat 100 may be constructed nonconductive material. Bottom layer 140 conceals second plate 130 and dielectric medium 120 and may be decorative in nature.

Figure 1B:
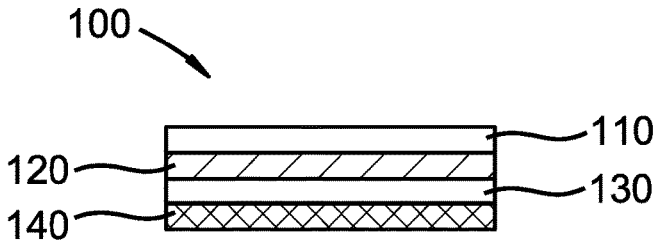
FIG. 1B illustrates a transverse cross-sectional view of the slat of FIG. 1A.

FIG. 1B is a transverse cross-sectional view of slat 100. First plate 110, second plate 130, dielectric medium 120, and bottom layer 140 are again shown in this view.

Figure 2A:
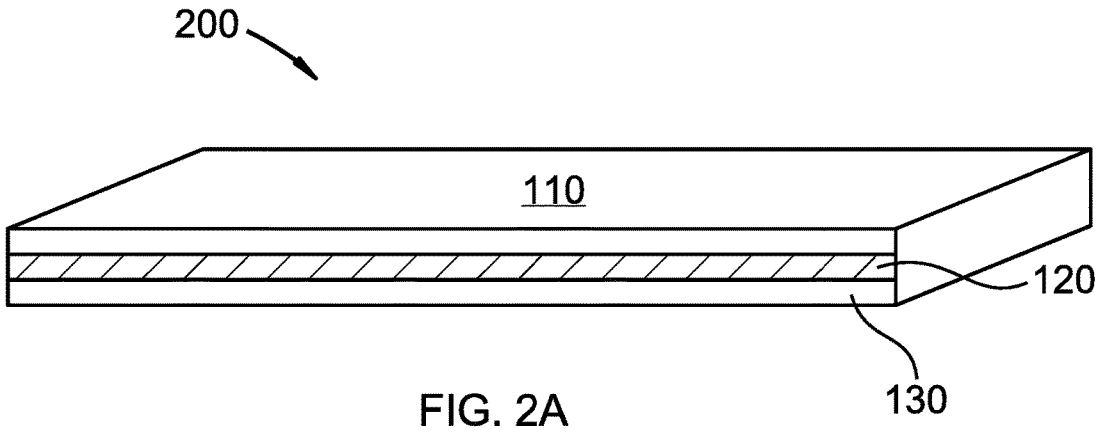
FIG. 2A illustrates a longitudinal cross-sectional view another embodiment of a slat of the disclosed window blind.

FIG. 2A illustrates a longitudinal cross-sectional view of slat 200 which may be included in an embodiment of the disclosed window blind. Similar to slat 100, slat 200 includes first plate 110 and second plate 130 which are separated by dielectric medium 120. In contrast, slat 200 has second plate 130 exposed rather than covered as in slat 100. Consequently, both plates of slat 200 may collect dust at the same time.

Figure 2B:
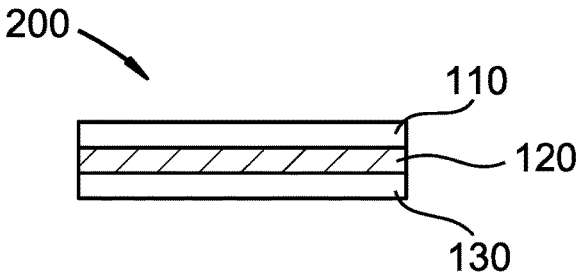
FIG. 2B illustrates a transverse cross-sectional view of the slat of FIG. 3A.

FIG. 2B is a transverse cross-sectional view of slat 200. First plate 110, second plate 130 and dielectric medium 120 are shown in this view.

Figure 3A:
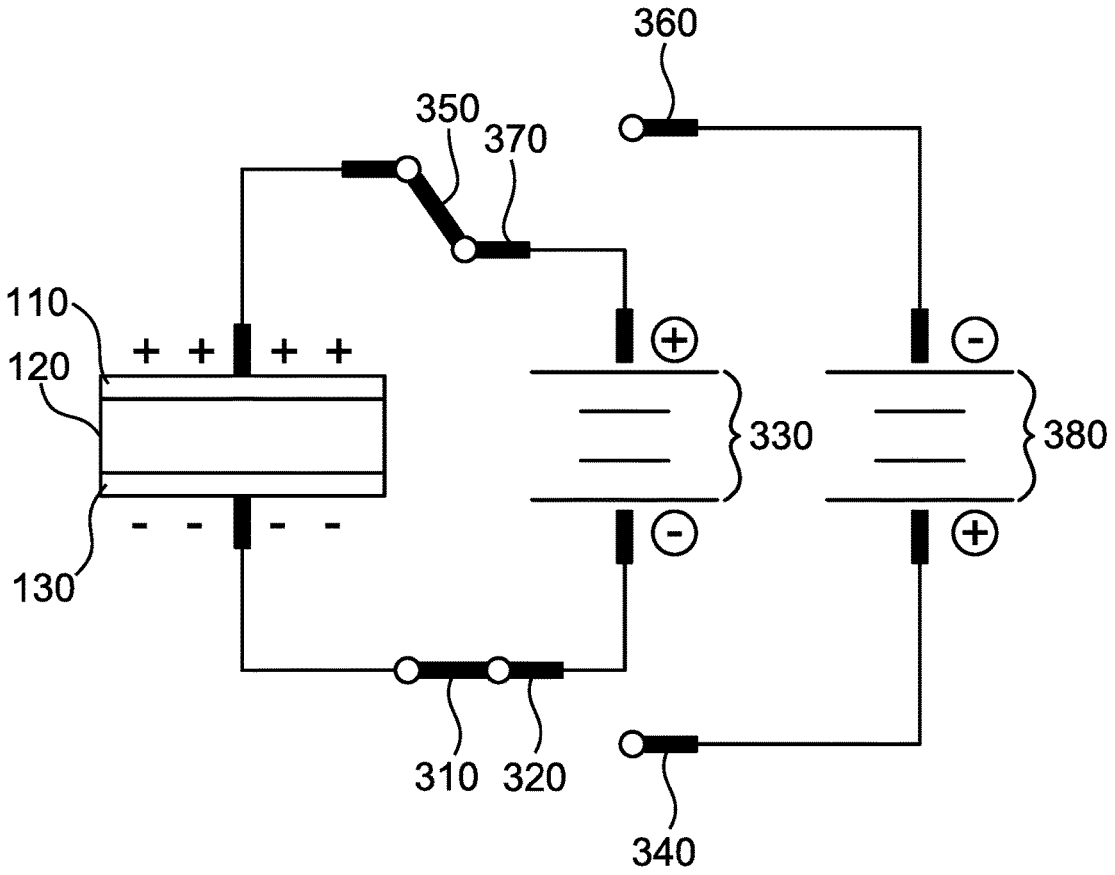
FIG. 3A illustrates a circuit diagram of a capacitor in an embodiment of a slat within the disclosed window blind with the top plate of the capacitor holding a positive charge.

FIG. 3A shows a circuit diagram with a schematic drawing of a capacitor which may be included in an embodiment of the disclosed window blind. A capacitor is shown comprising first plate 110, dielectric medium 120, and second plate 130. Switch 310 is shown connected to connection 320 creating an electrical connection with the anode of first battery 330. Current flows from first battery 330 to plate 130. Because dielectric medium 120 is between plate 130 and plate 110, the current cannot continue to complete the circuit. Therefore plate 130 retains a negative charge which repels electrons from plate 110 giving plate 110 a positive charge.

Figure 3B:
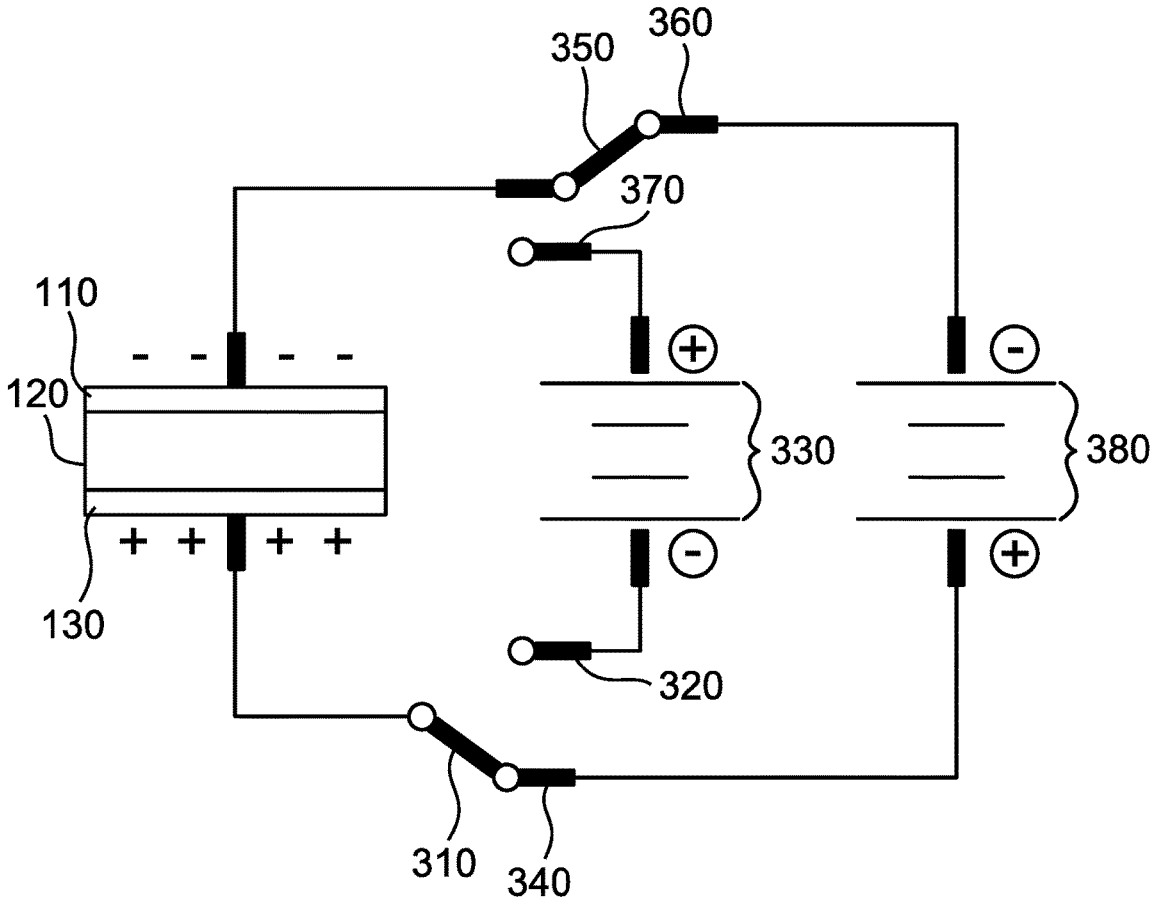
FIG. 3B illustrates the circuit diagram of FIG. 3A with the top plate of the capacitor holding a negative charge.

FIG. 3B shows the circuit of FIG. 3A with switch 310 connected to connection 340 rather than to connection 320. Thus, plate 130 is no longer connected to the anode of a battery and current does not flow to plate 130. In contrast switch 350 has moved from its connection with connector 370 as in FIG. 3A to a position in which switch 350 is connected to connector 360. Current now flows from the anode of second battery 380 to plate 110. Again, dielectric medium 120 prevents the completion of the circuit so a negative charge builds up on plate 110. This negative charge repels electrons on plate 130 giving plate 130 a positive charge. Thus, FIGS. 3A and 3B illustrate an embodiment in which the charges of plates 110 and 130 have been reversed.

Figure 4:
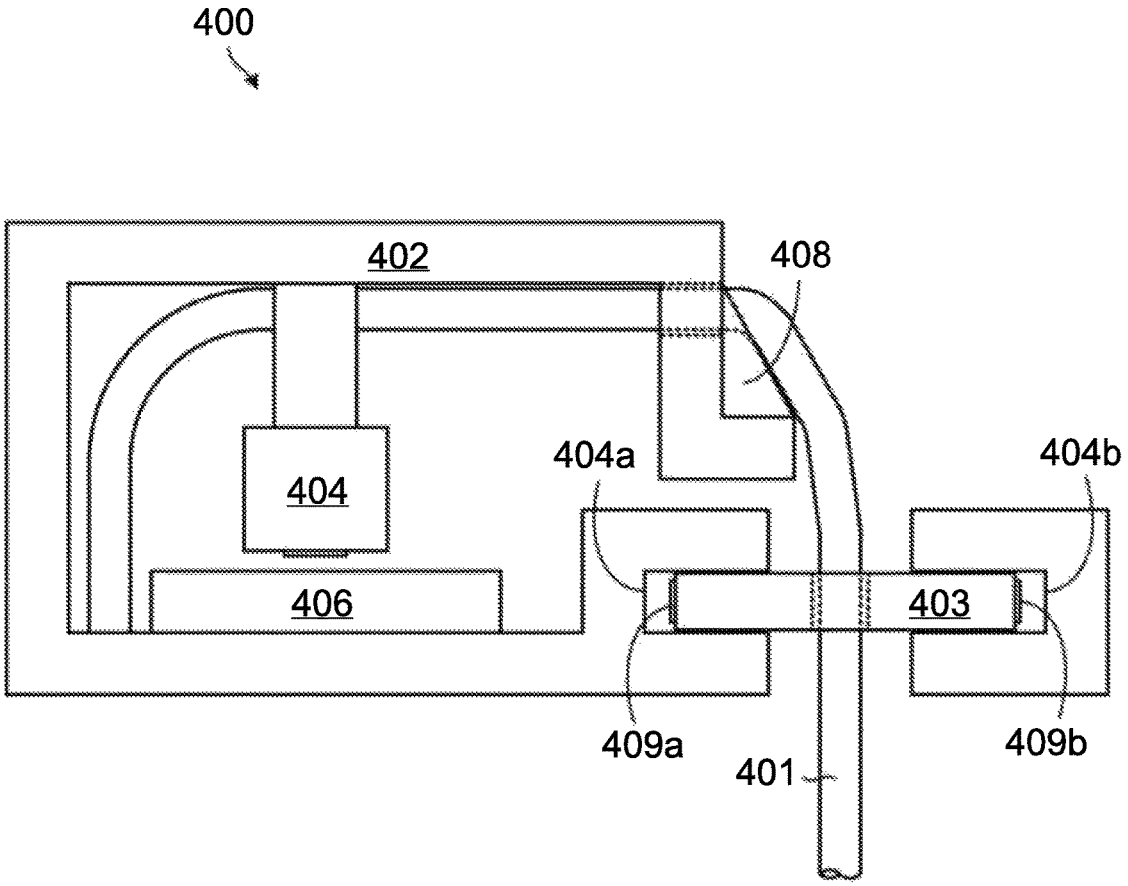
FIG. 4 illustrates a perspective view of one embodiment of a switching mechanism to receive cord gestures from a user in multiple directions.

FIG. 4 illustrates switching mechanism 400 which may be used to transmit signals from a pull cord to switches in an electrical system causing the polarity of the plates in a capacitor to reverse. Switching mechanism 400 may, in certain embodiments, be housed within the headrail of the disclosed window blind immediately above pull cord 401. Switching mechanism 400 includes deflectable arm 402 and first and second contacts 404 and 406 respectively. Deflectable arm 402 and first and second contacts 404 and 406 may be used to convert downward motion of the pull cord 401 into electrical signals. Chamfer 408 or other surface 408 may prevent an undesirable bend or stress in pull cord 401.

In addition, switching mechanism 400 includes slider 403 to understand side-to-side motion. As shown, slider 403 includes contact 409*a* and contact 409*b*. Side-to side movement of the pull cord 401 may cause slider 403 to move side-to-side. In certain embodiments, biasing members (not shown) such as springs may keep slider 403 substantially centered between contacts 404*a* and 404*b* when no force is applied.

When the slider 403 is moved in a first direction (leftward in the illustrated embodiment) the contact 402*a* may touch the contact 404*a*, thereby converting leftward lateral movement of the pull cord 401 into an electrical signal. Similarly, when the slider 403 is moved in a second direction (rightward in the illustrated embodiment) contact 402*b* may touch contact 404*b*, thereby converting rightward lateral movement of the pull cord 401 into an electrical signal. The electrical signals associated with the lateral movement of pull cord 401 may be used to actuate switches in an electrical system which may be the embodiment shown in FIGS. 3A and 3B.

Figure 5:
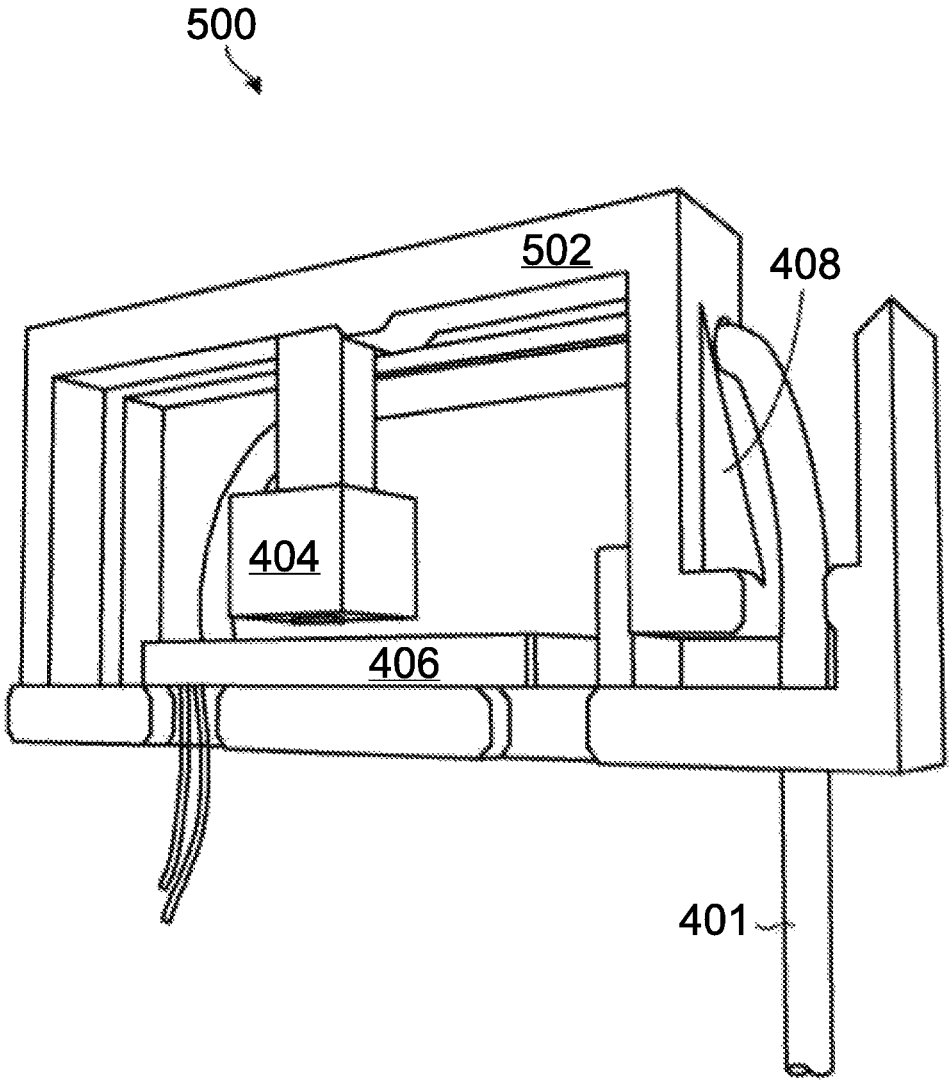
FIG. 5 illustrates a perspective view of one embodiment of a switching mechanism to receive cord gestures from a user in a single direction.

FIG. 5 illustrates switching mechanism 500 which may be used to convert pull cord gestures into electrical signals. Like switching mechanism 400 of FIG. 4, switching mechanism 500 may, in certain embodiments, may be housed within the headrail of the disclosed window blind immediately above pull cord 401. As shown, switching mechanism 500 includes deflectable arm 502 connected to contact 404. Pull cord 401 may be routed through or otherwise connected to deflectable arm 502. Chamfer 408 or other surface 408 may prevent an undesirable bend or stress in pull cord 401.

When pull cord 401 is tugged in a downward direction, deflectable arm 502 will deflect to move the contact 404 toward contact 406. Upon touching, a connection will occur and an electrical signal will be transmitted between contacts 404 and 406. In this way, cord gestures may be converted to electrical signals to actuate switches in an electrical system which may be the embodiment shown in FIGS. 3A and 3B.

Figure 6:
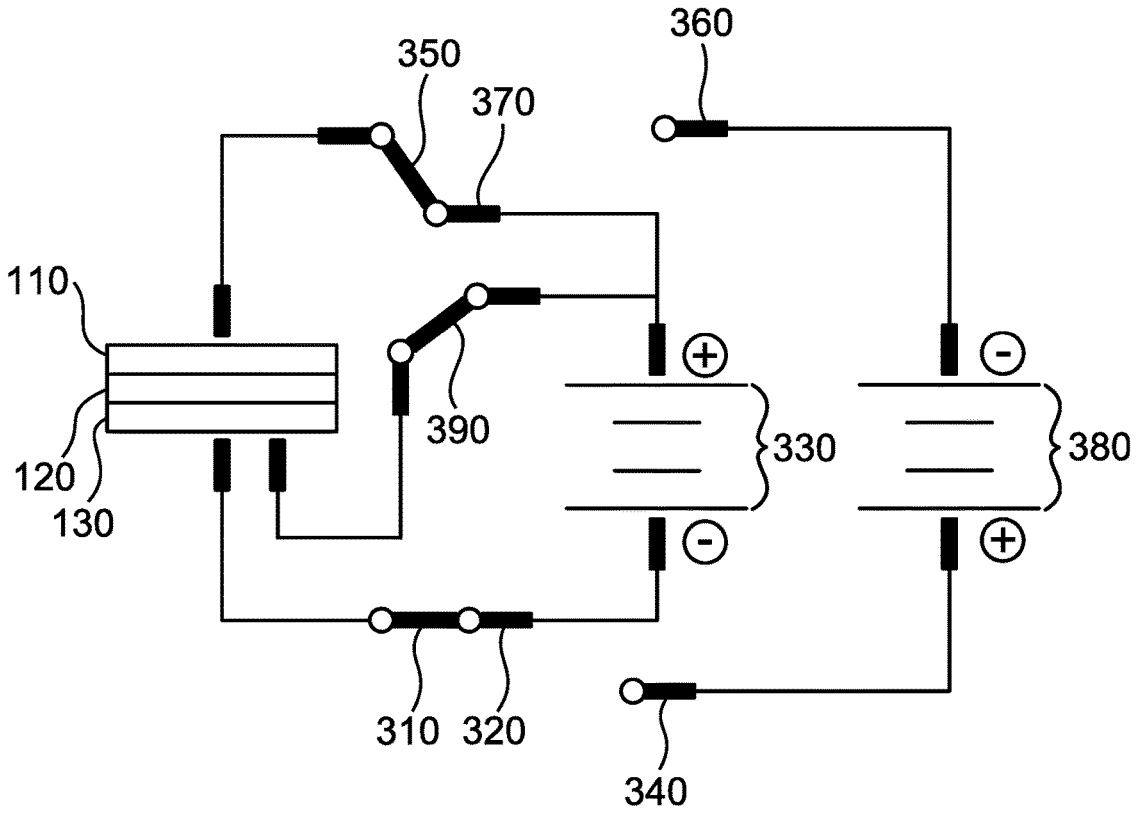
FIG. 6 illustrates a circuit diagram of the capacitor in an embodiment of a slat of the disclosed window blind in which the circuit is completed to one of the batteries.

FIG. 6 illustrates a circuit diagram with a schematic drawing of a capacitor which may be included in an embodiment of the disclosed window blind. The circuit diagram of FIG. 6 is essentially that of FIG. 3A with the addition of an electrical route for current to return from plate 130 to the cathode of first battery 330. This route includes switch 390 which, when in its closed position as shown in FIG. 6, creates a completed circuit. Thus, current that passes from the anode of first battery 330 through connector 320 and switch 310 returns to the cathode of first battery 330 through switch 390. Charge does not build up on plates 110 or 130. A user may use the pull cord to instruct the switches to align themselves as shown in FIG. 6 when the user wishes to wipe the dust off the plates and clean the slat.

Figure 7:
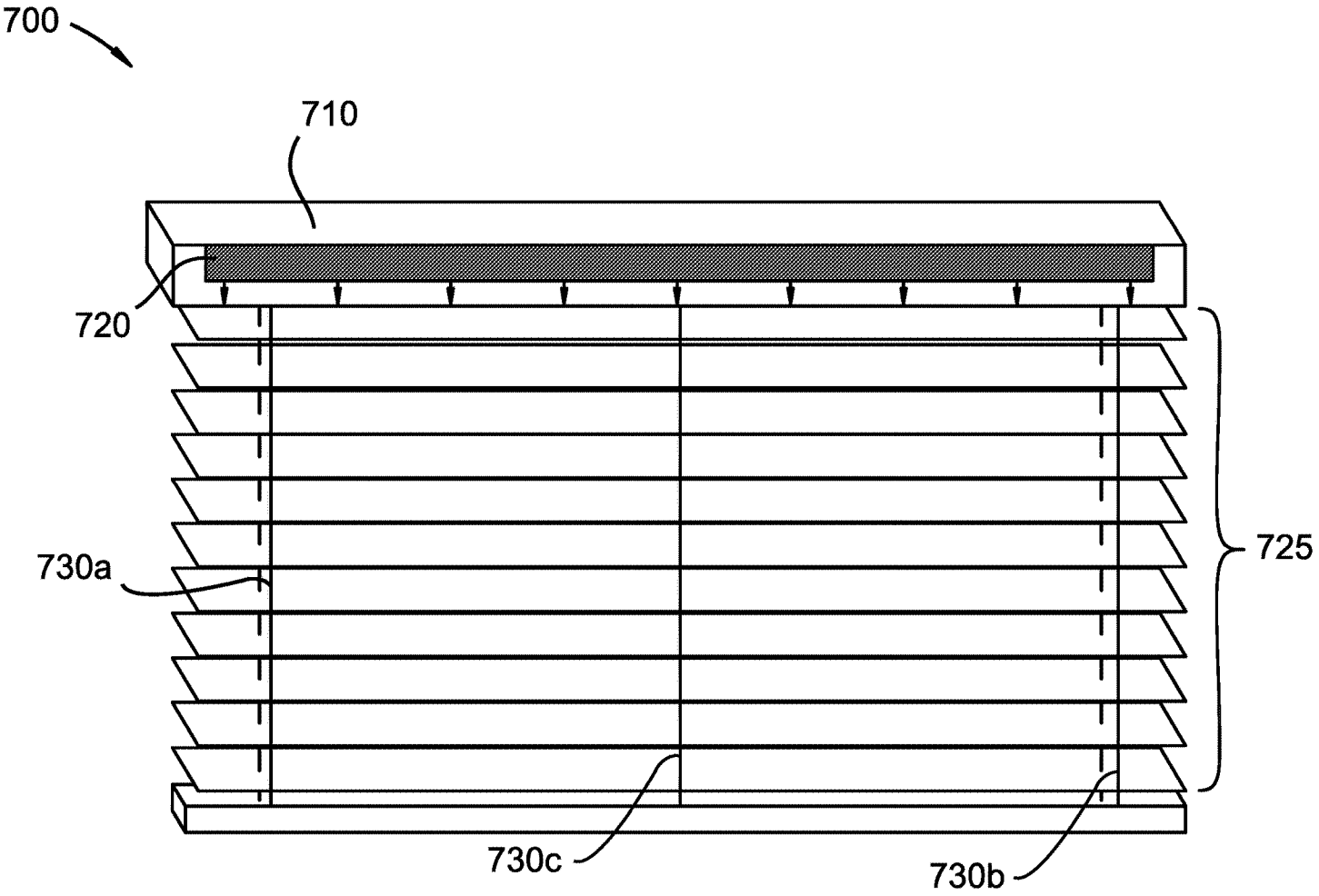
FIG. 7 illustrates a perspective view of an embodiment of the disclosed window blind with an air-moving device in the headrail.

FIG. 7 illustrates window blind 700 which is an embodiment of the disclosed window blind. Window blind 700 includes headrail 710. Air-moving device 720 is disposed within headrail 710. Arrows show the direction of air movement in the direction of plurality of slats 725. Window blind 700 further includes tilt strings 730*a*, 730*b*, and 730*c*. In some embodiments tilt strings 730*a*, 730*b*, and 730*c* may be disposed within hollow tubing. The hollow tubing may further include a main section of electrical wiring that may extend from the batteries which may be disposed within headrail 710 and include a plurality of extension wires that extend from the main section of electrical wiring and reach toward and connect to the plates within the capacitor in each slat.

While specific embodiments have been illustrated and described above, it is to be understood that the disclosure provided is not limited to the precise configuration, steps, and components disclosed. Various modifications, changes, and variations apparent to those of skill in the art may be made in the arrangement, operation, and details of the methods and systems disclosed, with the aid of the present disclosure.

Without further elaboration, it is believed that one skilled in the art can use the preceding description to utilize the present disclosure to its fullest extent. The examples and embodiments disclosed herein are to be construed as merely illustrative and exemplary and not a limitation of the scope of the present disclosure in any way. It will be apparent to those having skill in the art that changes may be made to the details of the above-described embodiments without departing from the underlying principles of the disclosure herein.

We claim:

1. A window blind comprising:
a headrail;
a plurality of movable slats, each of the slats comprising:
a capacitor, each capacitor comprising:
a first plate and a second plate both positioned on the respective slat; and
a dielectric medium disposed between each first and second plate;
a first switch and a second switch, and
a first battery and a second battery, each comprising:
an anode and a cathode,
wherein the first switch lies along an electrical connection which electrically connects the anode of the first battery to the first plate when the first switch is in a first position, and
wherein the second switch lies along an electrical connection which electrically connects the anode of the second battery to the second plate when the second switch is in a second position.

2. The window blind of claim 1, wherein the first and second batteries are disposed within the headrail.

3. The window blind of claim 1, further comprising a pull cord operably connected to the first switch and the second switch receiving pull cord gestures from a user.

4. The window blind of claim 3, further comprising a switching mechanism to convert the pull cord gestures into electrical signals.

5. The window blind of claim 4, wherein the switching mechanism detects pull cord gestures in a single direction.

6. The window blind of claim 4, wherein the switching mechanism detects pull cord gestures in multiple directions.

7. The window blind of claim 3, further comprising a controller, wherein the controller receives the cord gestures and translates the cord gestures into operational commands to control and operate the first switch and the second switch.

8. The window blind of claim 3, wherein the pull cord moves in a lateral motion, and wherein the pull cord applies force to slidably move a sliding connector to a first position or a second position, wherein the sliding connector electrically communicates exclusively with a first contact when in the first position or a second contact when in the second position.

9. The window blind of claim 3, wherein the pull cord moves in a vertical motion, wherein the pull cord applies force to a deflectable arm thereby moving the deflectable arm from a first position to a second position, wherein the deflectable arm is in electrical communication with a first contact when the pull cord is in a first position, and wherein the deflectable arm is in electrical communication with a second contact when the pull cord is in a second position.

10. The window blind of claim 3, wherein the first and second plates consist of one or more of the following: aluminum, tantalum, silver, and brass.

11. The window blind of claim 3, wherein the dielectric medium consists of one or more of the following: glass, ceramic, paper, mica, porcelain, polyethylene, polyimide, polypropylene, polystyrene, titanium dioxide, strontium titanate, barium strontium titanate, barium titanate, calcium copper titanate, biaxially-oriented polyethylene terephthalate, and polytetrafluoroethylene.

12. The window blind of claim 1, wherein the first plate of each slat is negatively charged when the first plate is electrically connected to the anode of the first battery.

13. The window blind of claim 1, wherein the second plate of each slat is negatively charged when the second plate is electrically connected to the anode of the second battery.

14. The window blind of claim 1, wherein the first plate comprises a top surface of each of the plurality of slats.

15. The window blind of claim 14, wherein the second plate comprises a bottom surface of each of the plurality of slats.

16. The window blind of claim 1, further comprising an air-moving device, wherein the air-moving device is disposed within the headrail.

17. The window blind of claim 16, wherein the air-moving device directs air flow toward a top surface of each of the plurality of slats.

* * * * *